US005642588A

United States Patent [19]

Sowers

[11] Patent Number: 5,642,588

[45] Date of Patent: Jul. 1, 1997

[54] CAM SPRING AUTOMATIC DOOR SEALING APPARATUS

[75] Inventor: David A. Sowers, Coral Springs, Fla.

[73] Assignee: Perfect Seal L.C., Coral Springs, Fla.

[21] Appl. No.: 634,655

[22] Filed: Apr. 18, 1996

[51] Int. Cl.[6] ..... E06B 7/20

[52] U.S. Cl. ..... 49/307; 49/310

[58] Field of Search ..... 49/310, 307, 308

[56] References Cited

U.S. PATENT DOCUMENTS

| | | | |
|---|---|---|---|
| 483,995 | 10/1892 | Delancy | 49/307 |
| 799,475 | 9/1905 | Learned | 49/307 |
| 1,697,408 | 1/1929 | Thompson | 49/310 |
| 2,033,241 | 3/1936 | Hawk | 20/67 |
| 2,062,229 | 11/1936 | Lewis | 49/308 |
| 2,199,860 | 5/1940 | Rogers et al. | 49/308 |
| 2,433,331 | 12/1947 | Beck | 20/68 |
| 3,250,314 | 5/1966 | Wetzel | 160/40 |
| 3,703,788 | 11/1972 | Rivers | 49/307 |
| 3,871,133 | 3/1975 | Ellingson, Jr. | 49/308 |
| 4,406,088 | 9/1983 | Berndt, Jr. | 49/309 |
| 4,425,738 | 1/1984 | Christensen | 49/310 |
| 4,805,345 | 2/1989 | Ohi | 49/308 |
| 4,947,584 | 8/1990 | Wexler | 49/307 |

*Primary Examiner*—Philip C. Kannan
*Attorney, Agent, or Firm*—Frank L. Kubler

[57] ABSTRACT

A sealing apparatus for use with a door which swings over a threshold between an open position and a closed position and has a door lower end spaced above said threshold and defining a gap between the door lower end and the threshold when the door is in the closed position, and has a door face and a door frame includes a mechanism mounting member; a gate member for closing the gap; a leaf spring having a leaf spring first end and a leaf spring second end, the leaf spring first end being secured to the gate member with a securing structure, and the leaf spring second end being secured to the mounting member with an anchoring structure, where a segment of the leaf spring angles upwardly and laterally to form a spring cam surface; a structure for guiding the gate member to move up and down relative to the door; a cam engaging member positioned above and substantially parallel with the gate member, the cam engaging member having a protruding end extending laterally from the door toward the door frame to abut the door frame as the door is closed, the cam engaging member having a cam engaging element positioned adjacent to the spring cam surface; a structure for guiding the cam engaging member to move laterally relative to the door; so that closing the door causes the door frame to depress the cam engaging member protruding end, thereby sliding the cam engaging member horizontally and causing the cam engaging element to abut and deflect the spring cam surface to pivot the leaf spring downwardly and to thereby lower the attached gate member to make sealing contact with the threshold.

15 Claims, 4 Drawing Sheets

CAM SPRING AUTOMATIC DOOR SEALING APPARATUS

BACKGROUND OF THE INVENTION

1. Field of the Invention:

The present invention relates generally to the field sealing devices which close the gap between the lower end of a closed door and the door threshold to prevent air from passing underneath the door. More specifically the present invention relates to a door lower end sealing apparatus including a gate member which is automatically raised by opening the door to permit the door to swing freely, and which is automatically lowered by closing the door, to seal the space between the threshold and the lower end of the door while the door is closed. A series of leaf springs is snugly fitted into the gate member. Each spring angles upwardly and laterally to form a spring cam surface and is engagingly wrapped around a spring anchoring fastener secured to an upright mounting member. The gate member is constrained to move up and down only. A cam engaging member is positioned above and parallel to the gate member, and an end of the cam engaging member protrudes laterally from the door to abut the door frame as the door is closed. The cam engaging member has a series of cam engaging notches recessed into its lower surface, and each cam engaging notch is fitted around a spring anchoring fastener. The cam engaging member is constrained to move longitudinally only.

Closing the door causes the door frame to depress the cam engaging member protruding end. This action slides the cam engaging member horizontally in one lateral direction and causes a cam engaging notch vertical wall to abut and deflect the spring cam surface to angle the spring downwardly and lower the attached gate member. Opening the door permits the lateral resilient force of the leaf springs on the notch side walls to drive the cam engaging member in the other lateral direction so that the protruding end once again protrudes from the side of the door. The leaf springs pivot upwardly into their initial position, lifting the gate member into the non-sealing position. The apparatus may be mounted on a lower face of the door or within the door lower end.

2. Description of the Prior Art:

There have long been sealing devices for closing the gap between the lower end of a door and the threshold, to prevent the passage of heated or cooled air for savings in energy costs. These devices have generally been complex and expensive to manufacture.

One such prior device is that of Beck, U.S. Pat. No. 2,433,331, issued on Dec. 30, 1947. Beck teaches a door bottom closing and sealing device contained within a channel structure which is secured to the lower end of a door. Beck includes a channel structure containing a sealing gate which is loosely suspended from a horizontal spring member. One end of the spring member is fixed and the other end protrudes laterally from the door. When the door is opened, the elastic memory of the spring member straightens the spring member and thereby raises and holds the sealing gate in an elevated position. When the door is closed, the door frame abuts and depresses the spring member protruding end and thus bows the spring member downwardly, lowering the attached sealing gate into contact with the floor. A problem with Beck is that the single holding point, free swinging sealing gate might rattle within the channel structure, making the door seem rickety. Another problem is that the loose suspension of the sealing gate makes the apparatus sloppy, weak and prone to failure.

Wexler, U.S. Pat. No. 4,947,584, issued on Aug. 14, 1990, discloses an automatic door bottom. A downward opening horizontal channel member is provided at the base of a door and contains a drop bar for making sealing contact with the floor. A push rod protrudes laterally from the door and is depressed by the door frame when the door is closed. Depressing the push rod causes a horizontal spring member much like that of Beck to bow downwardly, thereby lowering the attached drop bar. Magnets cause one end of the drop bar to descend before the other. The resilient action of the spring member raises the drop bar off the floor when the door is opened, and the push rod is freed to again protrude. The problems of Beck are again presented.

Christensen, U.S. Pat. No. 4,425,738, issued on Jan. 17, 1984, teaches an automatic threshold seal for a door. Christensen is Just another downwardly bowing axially compressed leaf spring structure with a protruding end and a suspended gate; as is Rivers, U.S. Pat. No. 3,703,788, issued on Nov. 28, 1972, which discloses an automatic door bottom; and Ellingson, Jr., U.S. Pat. No. 3,871,133, issued on Mar. 18, 1975, which teaches a door bottom weather sealing structure.

Berndt, Jr., U.S. Pat. No. 4,406,088, issued on Sep. 27, 1983, reveals a door bottom sealing apparatus. Berndt, Jr. includes an inverted channel member secured to the inner face of a door, at the bottom end of the door. A sealing member is pivotally retained within the channel member by a series of hanger linkages secured at their lower ends to the sealing member and at their upper ends to the channel member. Torsion springs bias the sealing member into an upward and laterally displaced position such that an end of the sealing member protrudes toward the door jamb. Closing the door depresses the protruding end of the sealing member and thereby pivots the sealing member downwardly on the hanger linkages to make contact with the floor. Opening the door frees the protruding end so that the torsion springs pivot the sealing member back to its elevated rest position. A problem with Berndt, Jr. is that the protruding end of the sealing member moves a pre-set, fixed distance when depressed and thus lowers the sealing member a constantly repeating fixed distance. Should some object obstruct the lowering of the sealing member, the closing of the door could damage the apparatus. Another problem is that the sealing member moves laterally as well as downwardly, making abrading sliding contact with the floor.

Ohi, U.S. Pat. No. 4,805,345, issued on Feb. 21, 1989, teaches a sealing device for a door. Ohi includes a drive bolt with a protruding end, and a pivoting linkage connected to the drive bolt and to a sealing gate. Closing the door depresses the protruding end and pivots the linkage to lower the sealing gate into contact with the floor. The distance the drive bolt is moved upon closing of the door is adjustable by rotating a tubular screw at the drive bolt protruding end. Despite this adjustability, the unexpected presence of an object below the door could cause damage, as indicated above for Berndt, Jr. Ohi is also relatively complex and expensive to manufacture.

Wetzel, U.S. Pat. No. 3,250,314, issued on May 10, 1966, discloses a seal for a folding partition, recessed into a channel within a door lower end. As disclosed in Berndt, Jr. and in Ohi, a sealing member is suspended from downwardly pivoting hanger linkages and lowered by action of a protruding bolt assembly. The problems of Berndt, Jr. are again presented.

Hawk, U.S. Pat. No. 2,033,241, issued on Mar. 10, 1936, reveals an automatic weather strip for preventing passage of rain, dust and hot or cold air beneath a door or window. The Hawk design is unusual in that no laterally protruding bolt assembly is provided. Instead a series of camming ramps are secured to the threshold beneath the door closed position. Vertical lift rods protrude down through the bottom of the door to ride up on these ramps when the door is closed, against the biasing of coil springs around the rods. An arm protrudes laterally from each rod toward a face of the door, and is connected to a pivoting sealing strip protruding out through a slot in the lower face of the door. Riding up on the ramps as the door closes lifts the rods, the arms and the inner edge of the sealing strip, pivoting the outer edge of the sealing strip downwardly into sealing contact with the threshold. A problem with Hawk is that the pivoting sealing strip structure is relatively delicate, and it could be damaged by abrupt contact with an obstacle in the path of the door. Another problem is that the downwardly protruding rods might touch and scratch the floor as the door swings.

It is thus an object of the present invention to provide a door sealing apparatus which automatically closes the gap between the door lower end and the threshold each time the door is closed.

It is another object of the present invention to provide such an apparatus which biases but does not force a sealing gate member toward a sealing position, so that an obstruction on the floor or threshold does not damage the apparatus.

It is still another object of the present invention to provide such an apparatus with a sealing gate member which cannot slide laterally during lowering and raising to minimize sliding and abrading contact with the threshold.

It is finally an object of the present invention to provide such an apparatus which is sturdy, simple and reliable in design, and relatively inexpensive to manufacture.

SUMMARY OF THE INVENTION

The present invention accomplishes the above-stated objectives, as well as others, as may be determined by a fair reading and interpretation of the entire specification.

A sealing apparatus is provided for use with a door which swings over a threshold and has a door lower end, a door face and a door frame, for closing the gap between the door lower end and the threshold, including a mechanism mounting member; a gate member for closing the gap; a leaf spring having a leaf spring first end and a leaf spring second end, the leaf spring first end being secured to the gate member with a securing structure, and the leaf spring second end being secured to the mounting member with an anchoring structure, where a segment of the leaf spring angles upwardly and laterally to form a spring cam surface; a structure for guiding the gate member to move up and down relative to the door; a cam engaging member positioned above and substantially parallel with the gate member, the cam engaging member having a protruding end extending laterally from the door toward the door frame to abut the door frame as the door is closed, the cam engaging member having a cam engaging element positioned adjacent to the spring cam surface; a structure for guiding the cam engaging member to move laterally relative to the door; so that closing the door causes the door frame to depress the cam engaging member protruding end, thereby sliding the cam engaging member horizontally in one lateral direction and causing the cam engaging element to abut and deflect the spring cam surface to pivot the leaf spring downwardly and to thereby lower the attached gate member to make sealing contact with the threshold, and so that opening the door permits the resilient force of the leaf spring on the cam engaging element to drive the cam engaging member in the other lateral direction so that the protruding end once again protrudes from the door, and so that the leaf spring resiliently pivots upwardly into its initial position, lifting the gate member out of sealing contact with the threshold.

The gate member preferably has a securing notch cut into its upper surface to retain part of the leaf spring, so that the gate member and the cam engaging member abut each other when the gate member is elevated to conserve space. The anchoring structure preferably includes an anchoring fastener which is fastened to the mounting member, and the second end of the spring is preferably engagingly wrapped around the anchoring fastener. An engaging notch is preferably recessed into the lower surface of the cam engaging member, and cam engaging element is preferably an end wall of the engaging notch, and the engaging notch is preferably positioned around the second end of the spring and the spring fastener. The structure for guiding the cam engaging member preferably includes a cam engaging member guide fastener extending from the mounting member through a substantially horizontal slot in the cam engaging member to free the cam engaging member to move laterally, and to simultaneously constrain the cam engaging member against substantial upward and downward movement.

The structure for guiding the gate member preferably includes a gate member guide fastener extending from the mounting member through a substantially vertical slot in the gate member to free the gate member to move up and down, and to simultaneously constrain the gate member against substantial lateral movement. The cam engaging member guide fastener preferably has a fastener head which overlaps the horizontal guide slot. The gate member guide fastener preferably has a fastener head which overlaps the vertical guide slot.

The apparatus preferably additionally includes a resilient sealing strip, and a groove is preferably recessed into the lower surface of the gate member for retaining the resilient sealing strip to abut the threshold and obstruct passage of air. The groove and the resilient sealing strip are preferably of T-shaped cross-section to permit the sealing strip to slide axially into and out of the groove for periodic replacement and to prevent the sealing strip from sliding downwardly out of the groove. The gate member and the cam engaging member are both preferably retained within an inverted channel-shaped housing with a vertical leg portion, the vertical leg portion constituting the mechanism mounting member. The housing is optionally retained within the door lower end. The housing is alternatively secured to the face of the door at the door lower end. The door face may constitute the mechanism mounting member.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
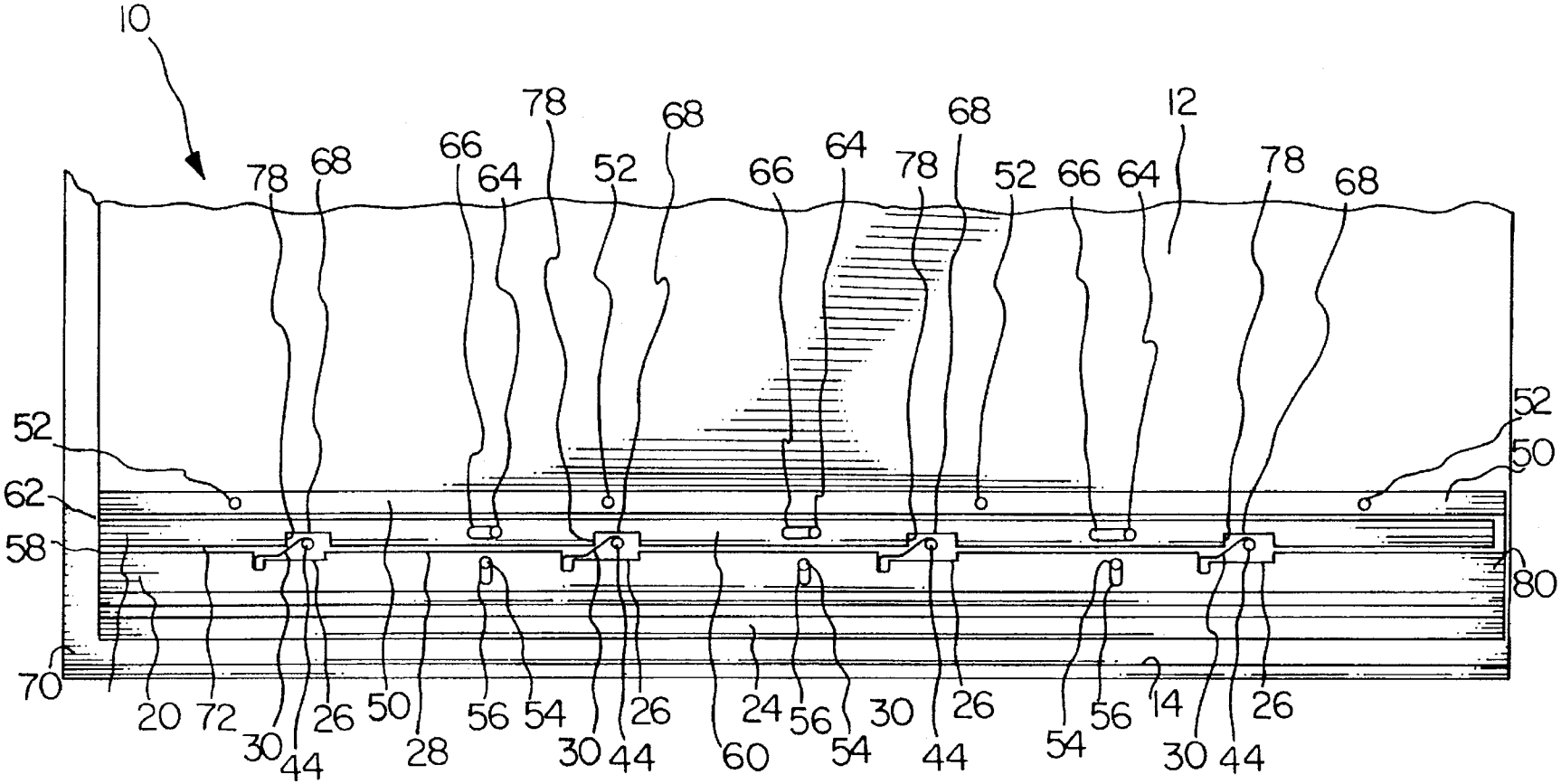
FIG. 1 is a front view of the preferred embodiment of the apparatus fitted to the lower end of a door, with the door in the open position and the sealing strip and gate member retracted.
Figures 2, 2A, 2B, 2C:
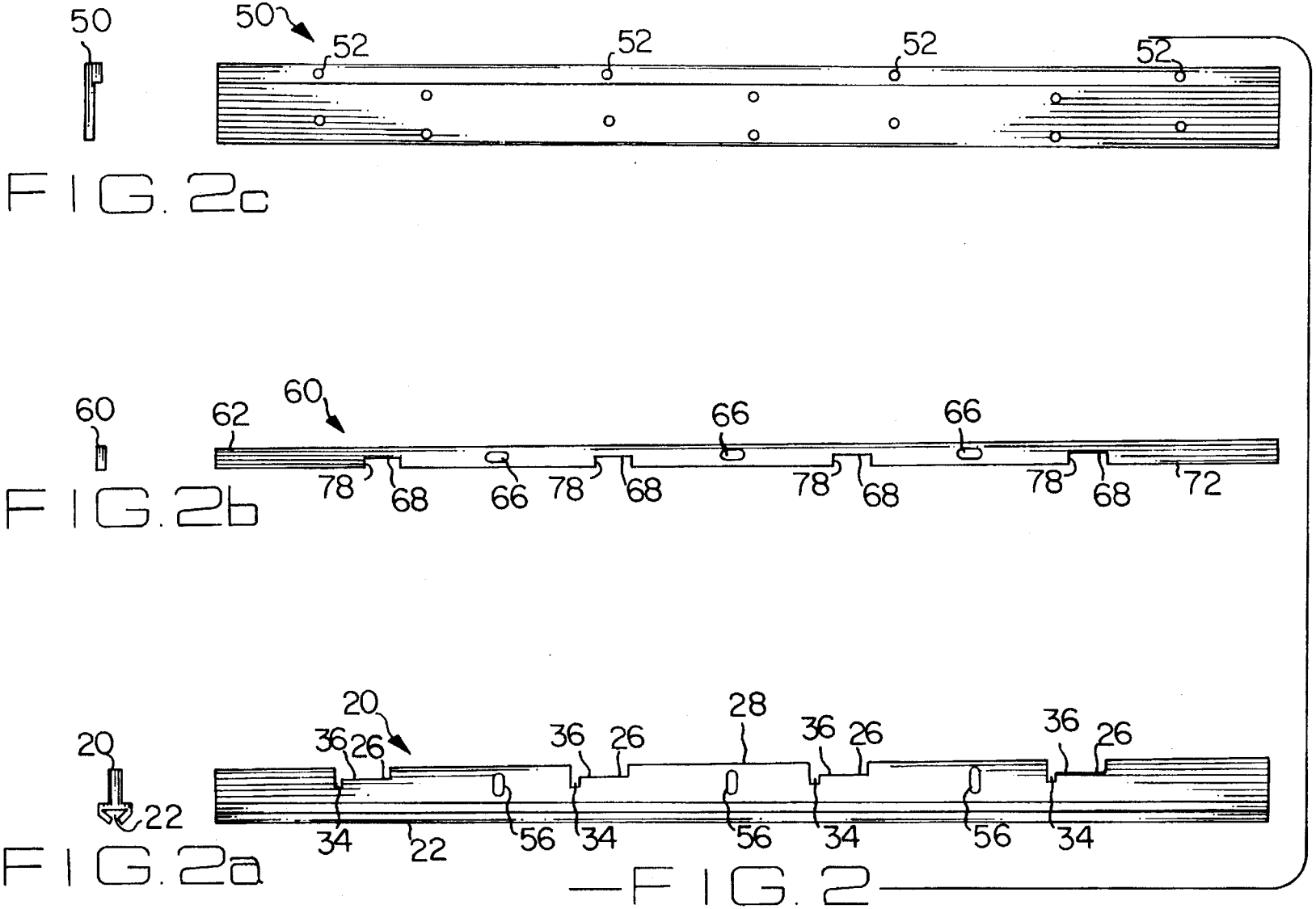
FIG. 2 is a partial exploded view of the apparatus including the mechanism mounting member, the cam engaging member and the gate member.
FIG. 2*a* shows the side profile of the gate member.
FIG. 2*b* shows the side profile of the camming member.
FIG. 2*c* shows the side profile of the upright mechanism mounting member.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Embodiments

Referring to FIGS. 1–9, an apparatus 10 is disclosed for closing the gap between a door 12 lower end 18 and the threshold 14 to obstruct the passage of air. Apparatus 10 includes a gate member 20 which is automatically raised by opening the door 12 to permit the door 12 to swing freely, and which is automatically lowered by closing the door 12, to seal the space between the threshold 14 and the door 12 lower end 18 when the door is closed.

Figure 3A:
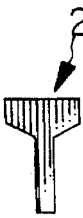
FIG. 3*a* is a side profile of the sealing strip, showing the T-shaped cross-section.
Figure 3:
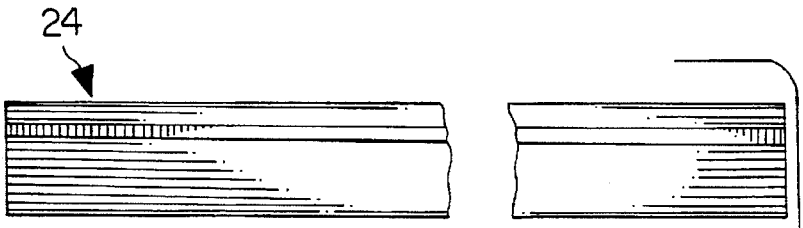
FIG. 3 is a front view of the preferred sealing strip.
Figure 4:
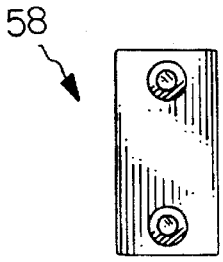
FIG. 4 is a front view of the striker plate.
Figure 7:
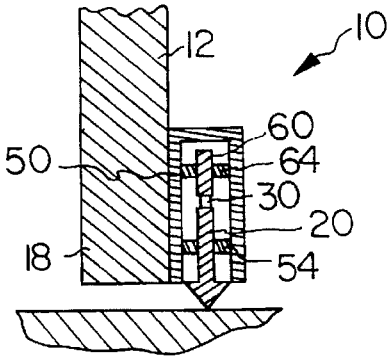
FIG. 7 is a cross-sectional side view of a door lower end having the inverted channel mechanism mounting member and housing secured to its outer face.
Figure 8:
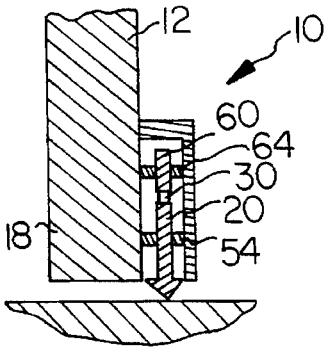
FIG. 8 is a cross-sectional side view of an embodiment of a door lower end having the inverted channel mechanism mounting member and housing wherein the leg portion mounting member is the door outer face.
Figure 9:
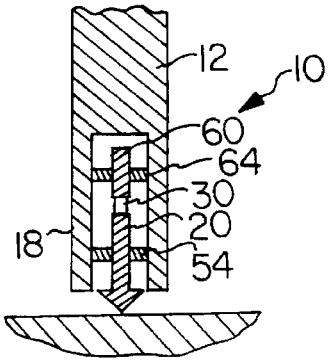
FIG. 9 is a cross-sectional side view of an embodiment of a door lower end having the inverted channel mechanism mounting member and housing wherein the mounting member and housing are retained or defined within the door lower end itself.
Figure 5:
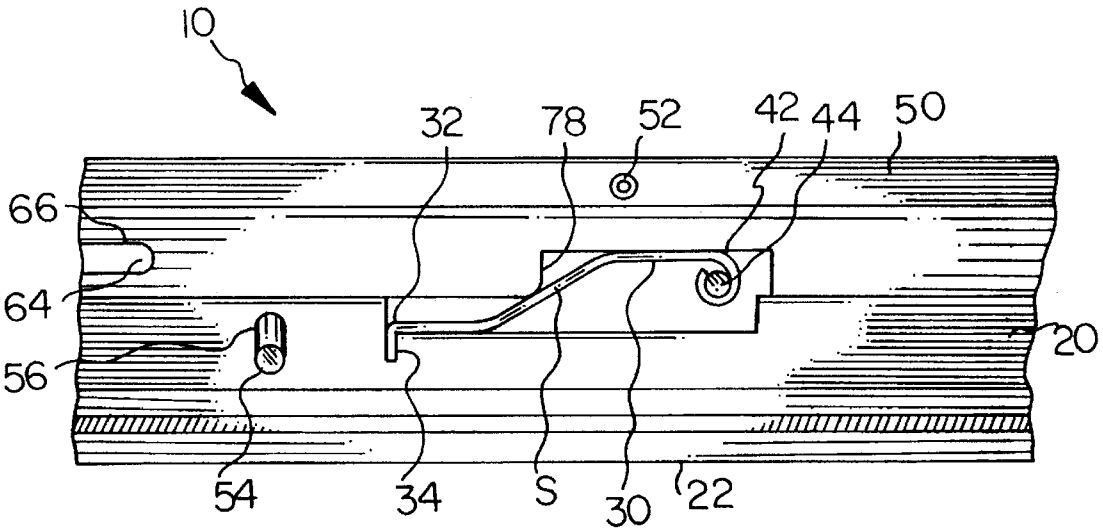
FIG. 5 is a broken away view, close-up view of the cam engaging member and the gate member in the raised position with the door open. The sealing strip is omitted.
Figure 6:
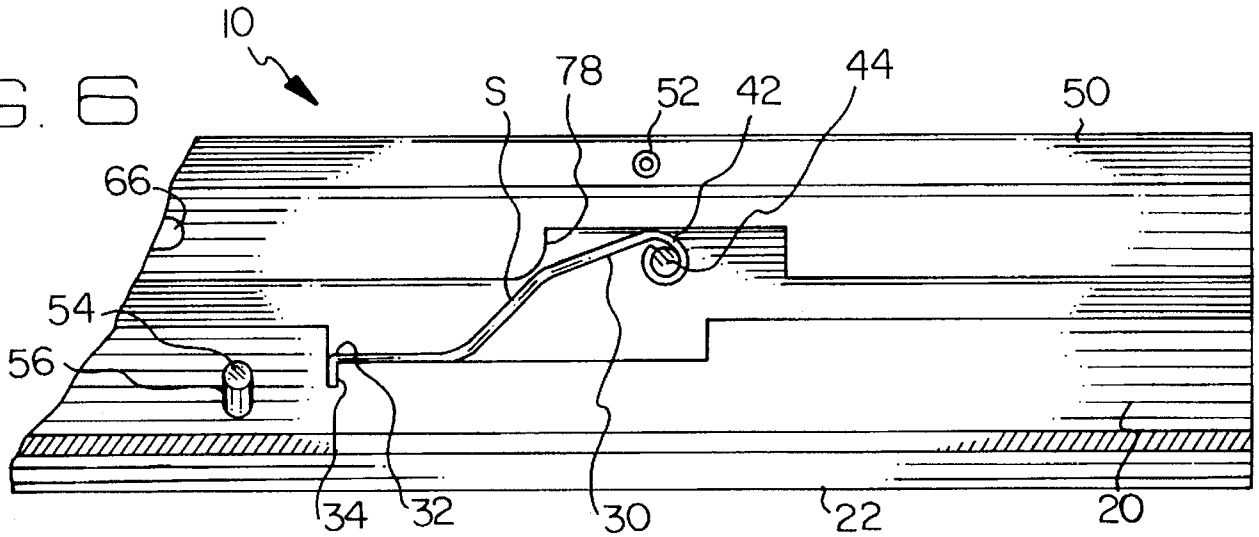
FIG. 6 is a view as in FIG. 5 is with the gate member in the lowered position with the door closed.

Gate member 20 is preferably an elongate slat having a groove 22 recessed into its lower surface for retaining a resilient sealing strip 24 to sealingly abut the threshold 14. See FIGS. 1, 2 and 2*a*. Groove 22 and resilient sealing strip 24 are preferably of T-shaped cross-section to permit sealing strip 24 to slide axially into and out of groove 22 for periodic replacement, and at the same time to prevent sealing strip 24 from sliding downwardly out of groove 22. See FIGS. 3 and 3*a*.

Gate member 20 has a series of elongate notches 26 cut into its upper surface 28, and a first end 32 of a leaf spring 30 is snugly fitted and secured into an upright groove 34 within each notch 26. See FIGS. 5 and 6. Notches 26 retain a portion of springs 30 to make apparatus 10 more compact. Each spring 30 extends laterally from the groove 34 along the bottom surface 36 of the notch 26, then angles upwardly. The portion of each spring 30 which angles upwardly forms a spring cam surface S. A second end 42 of each spring 30 is engagingly wrapped around a spring anchoring fastener 44 secured to an upright mechanism mounting member 50. Mounting member 50 is secured to door 12 with roll pins 52. Guide fasteners 54 extend from mounting member 50 through vertical guide slots 56 in gate member 20 to free gate member 20 to move up and down, and to simultaneously constrain gate member 20 against lateral movement. Each guide fastener 54 has a fastener head which slidably overlaps the guide slot 56.

A cam engaging member 60 is positioned above and parallel to gate member 20, and a protruding end 62 of cam engaging member 60 protrudes laterally from the door 12 to abut the door frame 70 as the door 12 is closed. See FIGS. 1, 2, 5 and 6. A striker plate 58 is fastened to the door frame 70 for protruding end 62 to strike, to prevent damage to the door frame 70. See FIG. 4. Cam engaging member 60 has a series of cam engaging notches 68 recessed into its lower surface 72, and each cam engaging notch 68 is fitted around a spring anchoring fastener 44. Guide fasteners 64 extend from mounting member 50 through horizontal guide slots 66 in cam engaging member 60 to free cam engaging member 60 to move laterally, and to simultaneously constrain gate member 60 against upward and downward movement. Each guide fastener 64 has a fastener head which slidably overlaps the guide slot 66.

Closing the door 12 causes the door 70 frame to depress the cam engaging member protruding end 62. This action slides cam engaging member 60 horizontally in one lateral direction and causes a cam engaging notch 68 vertical cam engaging wall 78 to abut and deflect the leaf spring 30 anchored within the notch 68 to angle the spring 30 downwardly and lower the attached gate member 20. See FIGS. 5 and 6.

The lowered gate member 20 makes sealing contact with the threshold 14 while the door 12 is closed. Opening the door 12 permits the lateral resilient force of the leaf springs 30 on the notch 68 side walls to drive the cam engaging member 60 in the other lateral direction so that the protruding end 62 once again protrudes from the side surface of the door 12. The leaf springs 30 pivot upwardly into their initial position, lifting the gate member 20 into the non-sealing position. See FIGS. 5 and 6.

Gate member 20 and cam engaging member 60 are both preferably retained within an inverted channel-shaped housing 80, a vertical leg of which constitutes upright mounting member 50. Housing 80 is either retained within the lower end 18 of the door 12 itself, or is secured to a face of the door 12 at the door lower end 18. See FIGS. 7–9.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A sealing apparatus for use with a door which swings over a threshold between an open position and a closed position and has a door lower end spaced above said threshold and defining a gap between the door lower end and the threshold when the door is in the closed position, and has a door face and a door frame, for closing the gap between the door lower end and the threshold, comprising:

a mechanism mounting member;

a gate member for closing said gap;

a leaf spring having a leaf spring first end and a leaf spring second end, said leaf spring first end being secured to said gate member with securing means, and said leaf spring second end being secured to said mounting member with anchoring means, wherein a segment of said leaf spring angles upwardly and laterally to form a spring cam surface;

means for guiding said gate member to move up and down relative to said door;

a cam engaging member positioned above and substantially parallel with said gate member, said cam engaging member having a protruding end extending laterally from said door toward said door frame to abut said door frame as said door is closed, said cam engaging member having a cam engaging element positioned adjacent to said spring cam surface;

means for guiding said cam engaging member to move laterally relative to said door;

such that closing said door causes said door frame to depress said cam engaging member protruding end, thereby sliding said cam engaging member horizontally in one lateral direction and causing said cam engaging element to abut and deflect said spring cam surface to pivot said leaf spring downwardly and to thereby lower the attached said gate member to make sealing contact with said threshold, and such that opening said door permits the resilient force of said leaf spring on said cam engaging element to drive said cam engaging member in the other lateral direction such that said protruding end once again protrudes from said door, and such that said leaf spring resiliently pivots upwardly into its initial position, lifting said gate member out of sealing contact with said threshold.

2. The apparatus of claim 1, wherein said gate member has a securing notch cut into its upper surface to retain part of said leaf spring, such that said gate member and said cam engaging member abut each other when said gate member is elevated to conserve space.

3. The apparatus of claim 1, wherein said anchoring means comprises an anchoring fastener which is fastened to said mounting member, wherein said second end of said spring is engagingly wrapped around said anchoring fastener.

4. The apparatus of claim 1, additionally comprising an engaging notch recessed into the lower surface of said cam engaging member, wherein said cam engaging element is an end wall of said engaging notch, and wherein said engaging notch is positioned around said second end of said spring and said spring fastener.

5. The apparatus of claim 1, wherein said means for guiding said cam engaging member comprises a cam engaging member guide fastener extending from said mounting member through a substantially horizontal slot in said cam engaging member to free said cam engaging member to move laterally, and to simultaneously constrain said cam engaging member against substantial upward and downward movement.

6. The apparatus of claim 5, wherein said cam engaging member guide fastener has a fastener head which overlaps said horizontal guide slot.

7. The apparatus of claim 1, wherein said means for guiding said gate member comprises a gate member guide fastener extending from said mounting member through a substantially vertical slot in said gate member to free said gate member to move up and down, and to simultaneously constrain said gate member against substantial lateral movement.

8. The apparatus of claim 7, wherein said gate member guide fastener has a fastener head which overlaps said vertical guide slot.

9. The apparatus of claim 1, additionally comprising a resilient sealing strip, wherein a groove is recessed into the lower surface of said gate member for retaining said resilient sealing strip to abut said threshold and obstruct passage of air.

10. The apparatus of claim 9, wherein said groove and said resilient sealing strip are of T-shaped cross-section to permit said sealing strip to slide axially into and out of said groove for periodic replacement and to prevent said sealing strip from sliding downwardly out of said groove.

11. The apparatus of claim 1, wherein said gate member and said cam engaging member are both retained within an inverted channel-shaped housing with a vertical leg portion, said vertical leg portion constituting said mechanism mounting member.

12. The apparatus of claim 11, wherein said housing is retained within said door lower end.

13. The apparatus of claim 11, wherein said housing is secured to said face of said door at said door lower end.

14. The apparatus of claim 1, wherein said door face constitutes said mechanism mounting member.

15. A door and sealing apparatus, comprising:

a threshold;

a door mounted to swing over said threshold between an open position and a closed position and having a door lower end spaced above said threshold and defining a gap between the door lower end and the threshold when the door is in the closed position, and has a door face and a door frame:

a mechanism mounting member;

a gate member for closing the gap between said door lower end and said threshold;

a leaf spring having a leaf spring first end and a leaf spring second end, said leaf spring first end being secured to said gate member with securing means, and said leaf spring second end being secured to said mounting member with anchoring means, wherein a segment of said leaf spring angles upwardly and laterally to form a spring cam surface;

means for guiding said gate member to move up and down relative to said door;

a cam engaging member positioned above and substantially parallel with said gate member, said cam engaging member having a protruding end extending laterally from said door toward said door frame to abut said door frame as said door is closed, said cam engaging member having a cam engaging element positioned adjacent to said spring cam surface;

means for guiding said cam engaging member to move laterally relative to said door;

such that closing said door causes said door frame to depress said cam engaging member protruding end, thereby sliding said cam engaging member horizontally in one lateral direction and causing said cam engaging element to abut and deflect said spring cam surface to pivot said leaf spring downwardly and to thereby lower the attached said gate member to make sealing contact with said threshold, and such that opening said door permits the resilient force of said leaf spring on said cam engaging element to drive said cam engaging member in the other lateral direction such that said protruding end once again protrudes from said door, and such that said leaf spring resiliently pivots upwardly into its initial position, lifting said gate member out of sealing contact with said threshold.

* * * * *